US006595160B1

(12) United States Patent
Williamson

(10) Patent No.: US 6,595,160 B1
(45) Date of Patent: Jul. 22, 2003

(54) DOG EXERCISE APPARATUS AND METHOD

(75) Inventor: Michael M. Williamson, Statesville, NC (US)

(73) Assignee: SportsTec, Inc., Lincoln, NE (US)

( * ) Notice: Subject to any disclaimer, the term of this patent is extended or adjusted under 35 U.S.C. 154(b) by 0 days.

(21) Appl. No.: 09/642,186

(22) Filed: Aug. 18, 2000

(51) Int. Cl.[7] ..... A01K 15/02; F41B 7/00; F41A 9/61

(52) U.S. Cl. ..... 119/702; D22/106; 124/20.1; 124/45

(58) Field of Search ..... 119/702, 174, 119/905; D21/301; D22/100, 106, 107; 124/20.1, 20.2, 20.3, 23.1, 25.7, 45, 51.1; 273/317.3

(56) References Cited

U.S. PATENT DOCUMENTS

| | | | | | |
|---|---|---|---|---|---|
| 271,568 | A | * | 1/1883 | Bower et al. | 124/45 |
| 1,960,645 | A | * | 5/1934 | Parrish | 124/45 |
| 3,630,186 | A | * | 12/1971 | Babyn | 124/23.1 |
| 4,094,294 | A | * | 6/1978 | Speer | 124/51.1 |
| 4,116,192 | A | * | 9/1978 | Scott | 124/51.1 |
| D352,086 | S | * | 11/1994 | Ott | D22/106 |
| D352,337 | S | * | 11/1994 | Nagel et al. | D22/106 |
| 5,415,150 | A | * | 5/1995 | Dallas | 124/45 |
| 5,579,749 | A | * | 12/1996 | Wilkinson | 124/20.1 |
| 5,887,578 | A | * | 3/1999 | Backeris et al. | 124/49 |

* cited by examiner

*Primary Examiner*—Charles T. Jordan
*Assistant Examiner*—Elizabeth Shaw
(74) *Attorney, Agent, or Firm*—Vincent L. Carney

(57) ABSTRACT

To exercise a dog, a tennis ball throwing apparatus includes: (1) an open storage compartment for holding spare items such as spare tennis balls exposed to air for drying the ball; (2) a safety feature to prevent the dog exerciser from being used for throwing small sharp items; (3) a sling arrangement that permits easily throwing of balls a long distance; and (4) an apparatus that permits balls to be picked up without either bending down or touching them with the hands. The balls may be loaded in the storage compartment and later put in a pouch one by one to throw them without touching them. Balls that a dog retrieves may be picked up using the sling without touching the ball and it is automatically put into a storage compartment where it is exposed to air for drying purposes.

12 Claims, 4 Drawing Sheets

DOG EXERCISE APPARATUS AND METHOD

BACKGROUND OF THE INVENTION

This invention relates to dog exercise apparatus and methods.

It is known to exercise a dog by throwing items for the dog to fetch and bring back. This method of exercise has several disadvantages under some circumstances, such as for example: (1) some persons have difficulty repeatedly throwing an item any substantial distance for the dog to retrieve; (2) retrieving the item from the dog after the dog has retrieved it can cause delay or force the person exercising the dog to get saliva on his or her hands from a wet item; and (3) if more than one item is needed such as for example when it is desired to throw another item before retrieving the last item thrown, the person exercising the dog must have something in which to carry both items.

Throwing devices are known for throwing objects with some mechanical advantage to enable ease in throwing. Prior art throwing apparatuses include slings having an elastic member with a pouch on it. The item being thrown is temporarily held in the pouch and the pouch and item are pulled back, stretching the elastic member, and released to throw the item.

The prior art slings have several disadvantages, such as: (1) if they are used to throw something such as an item for a dog to retrieve, the item must still be picked up and may still be wet with saliva; (2) the sling may be used by children or the like to throw dangerous projectiles; and (3) some such slings are not well designed for efficiency in throwing.

SUMMARY OF THE INVENTION

Accordingly, it is an object of the invention to provide a novel method and apparatus for exercising a dog.

It is a still further object of the invention to provide a novel method for exercising a dog that does not require the handling of items covered with saliva.

It is a still further object of the invention to provide a novel method for exercising dogs which can be tailored for certain types of items to be thrown such as tennis balls or the like.

It is a still further object of the invention to provide an improved sling shot designed for convenience of use.

It is a still further object of the invention to provide a sling or throwing device which includes a convenient storage compartment for multiple items that are to be thrown and particularly a storage compartment in which the stored items may dry such as a storage compartment in which balls retrieved by a dog may dry.

It is a still further object of the invention to provide a throwing device which is designed to limit the items being thrown and exclude, for example, dangerous sharp projectiles.

In accordance with the above and further objects of the invention, a throwing apparatus is provided for throwing balls or other safe items for a dog to retrieve. The throwing apparatus includes: (1) a storage compartment for holding spare items such as spare tennis balls; (2) means for permitting stored items to rapidly dry; (3) a safety feature to prevent it from being used for throwing small sharp items; (4) a sling arrangement that permits easily throwing items a long distance; and (5) an apparatus that permits items to be picked up without either bending down or touching them with the hands.

In use, items to be thrown may be loaded in the storage compartment and later put in a projectile pouch one by one to throw them without touching them. Items that a dog retrieves may be picked up using the sling without touching the ball and it is automatically put into a storage compartment where it is exposed to air for drying purposes. The operator thus may throw the ball with the device a considerable distance and when it is retrieved, if the dog is trained to drop it, pick it up without touching it and keep it in the storage compartment until it is dry. In the meantime, a new projectile may be thrown. Moreover, a new projectile may be thrown, if necessary, if the dog does not release the projectile, in an effort to cause the dog to drop the last-retrieved item and retrieve the new projectile.

In the preferred embodiment, the throwing apparatus includes a projectile holder, a frame and a storage compartment. The projectile holder is designed to accommodate particular projectiles such as a tennis ball in the preferred embodiment and to reject others such as to reject small hard objects in favor of tennis balls. The storage compartment is a spring-loaded holder that may be used to pick up and store the projectiles. In the preferred embodiment, the frame is elongated and supports both a projectile throwing sling, and the storage compartment in a compact, easy to assemble construction where the projectile thrower and storage compartment share a common member between them on the elongated frame so that the spring-loaded storage compartment can conveniently reach from the hand of the user to the ground to pick up a tennis ball or other projectile. In the preferred embodiment, the projectile is picked up by pushing downwardly with the end of the storage compartment on top of the ball until the ball is forced inside and held by the spring-loaded holder. The projectile thrower in the preferred embodiment consists of elastomeric bands that serve as thrust bands. A pouch sized to receive a tennis ball holds the projectile on the elastomeric bands as the elastomeric bands are stretched and released to throw the projectile. The pouch has an opening in the center sized to so that sharp small objects fit through the hole and are not be usable with the pouch. Thus they are rejected and the dog exerciser cannot be turned into a dangerous weapon-like toy.

For convenient holding and aiming, the throwing apparatus includes a centrally located vertical cylindrical hand grip connected at its upper end to the combined wing-sight and thrust-band holder and connected at its lower end to an arm rest apparatus extending toward the user from the hand grip and ending in a curved member that may rest on top of the outstretched arm holding the hand grip. This permits sighting from the outstretched arm and provides room for the elastomeric thrust bands to be pulled back for convenient sighting and usage with small effort.

In use, the projectile, which in the preferred embodiment is a tennis ball, is pulled free from the spring-loaded holder. This may be done directly with the fingers but if the throwing apparatus is used as a dog exerciser, the projectile may have saliva on it. If the user wishes, the user may take the projectile holder which is a flexible piece of cloth and use it to pull the ball free by placing the ball in the projectile holder gripping it tightly and pulling it out of the spring-loaded holder. The projectile holder with the projectile in it is then pulled back towards the person on top of the frame and sighted through the wing sights forming the top of the projectile thrower. With the arm holding the hand grip outstretched and the arm rest on the top of the arm to steady the throwing apparatus, the projectile holder and projectile are pulled backward, stretching the elastomeric thrust bands. The projectile holder may then be released and the projectile will go towards its target. When used as a dog exerciser, the dog will normally drop what it is returning from the previous use and chase the projectile, fetching it and bringing it back to the user. The throwing apparatus cannot be misused by children or the like to throw sharp objects because of the opening in the projectile holder. It may however, be safely used to pick up projectiles that have been dropped on the ground and to throw the projectiles a substantial distance with very little effort.

From the above description, it can be understood that the throwing apparatus of this invention has several advantages, such as: (1) it may be used as a convenient pickup device without getting dog saliva on the hand or bending down; (2) it stores several projectiles in a manner in which they are exposed to air; (3) it is safe to use and cannot be used to throw dangerous objects; (4) it may be used with either arm because of the central location of the grip and its symmetry; and (5) it is economical to construct because of its symmetrical form and use of a common spring like member to form a wing sight, throwing mechanism holder and storage compartment.

BRIEF DESCRIPTION OF THE DRAWINGS

The above noted and other features of the invention will be better understood from the following detailed description when considered with reference to the accompanying drawings, in which.

DETAILED DESCRIPTION

Figure 1:
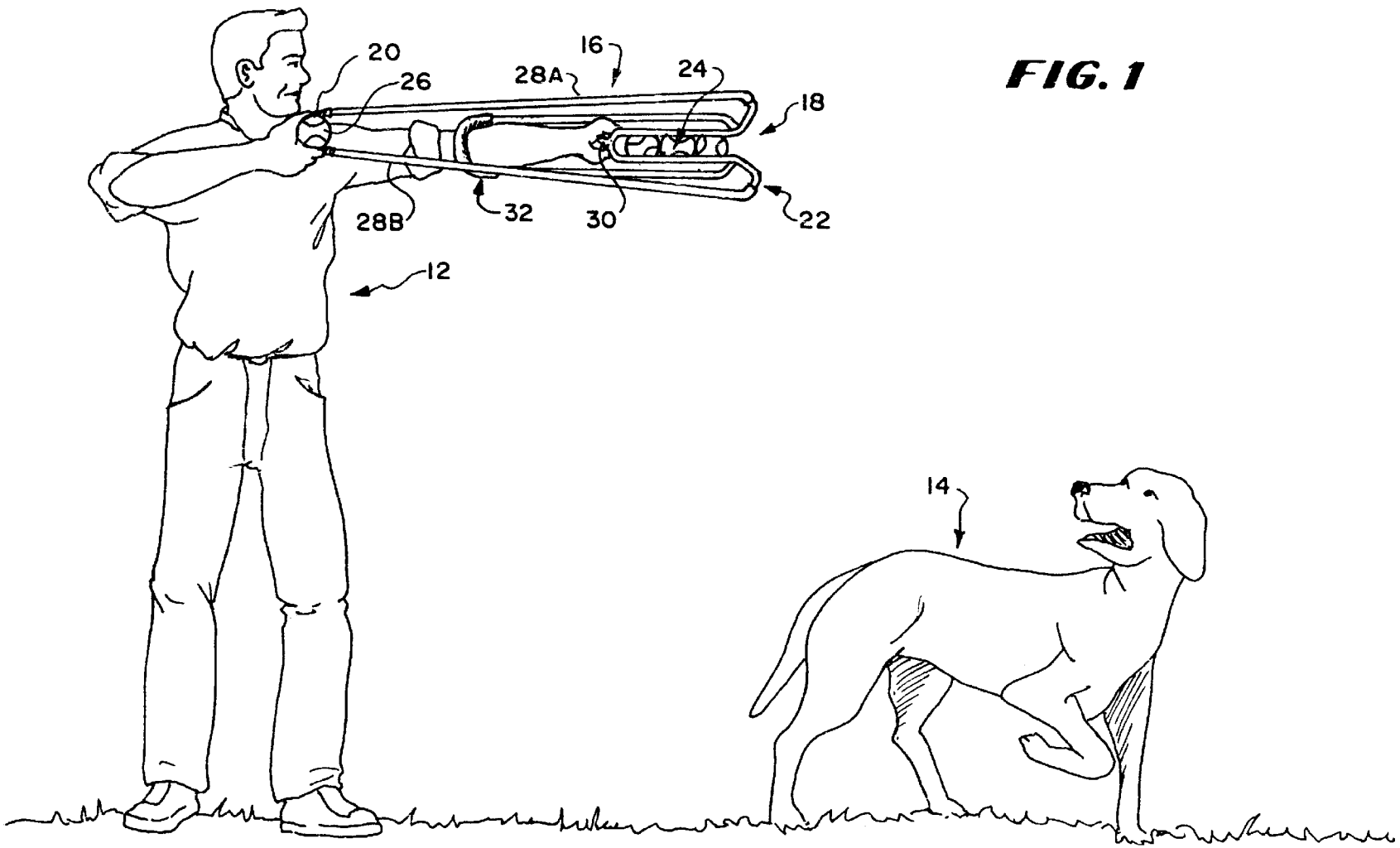
FIG. 1 is an illustration showing of the use of the throwing apparatus of this invention and a particular method of using it to exercise a dog.

In FIG. 1 there is shown a person 12 using the projectile thrower 16 to throw a tennis ball for the dog 14 to fetch. In doing so, the person 12 reaches into a storage compartment 24 of the throwing apparatus 16 and removes a ball. Then, holding the grip 30 in one hand (the left hand in FIG. 1) with the arm outstretched (left arm in FIG. 1) pulls the projectile holder 20 with a tennis ball 26 in it back, stretching elastomeric throwing bands 28A and 28B. He can sight through the wing sight 18 between the two sections of a frame 22 that mounts the thrust bands 28A and 28B and release the projectile holder 20, causing the ball to proceed a substantial distance for the dog 14 to retrieve it. While the arm is outstretched as shown in FIG. 1, the frame 22 rests upon the arm of the person 12, being aided by the armrest assembly 32.

While in the embodiment of FIG. 1, the throwing apparatus 16 is used to throw tennis balls, other kinds of projectiles may be thrown although the projectile holder 20 should be designed for the projectile to have adequate surface area to hold the projectile and an opening too small for the projectile to fall through but sufficiently large to preclude undesirable objects. Moreover, while the storage compartment 24 is shown designed to have the projectile removed and inserted from the same end, it would be possible to form an enlarged portion at the end opposite from the end into which the projectile is inserted for removal of projectiles. Similarly, while elastomeric bands are used, it is possible to utilize other types of thrusting devices besides the elastomeric thrust bands 28A and 28B of FIG. 1.

Figure 2:
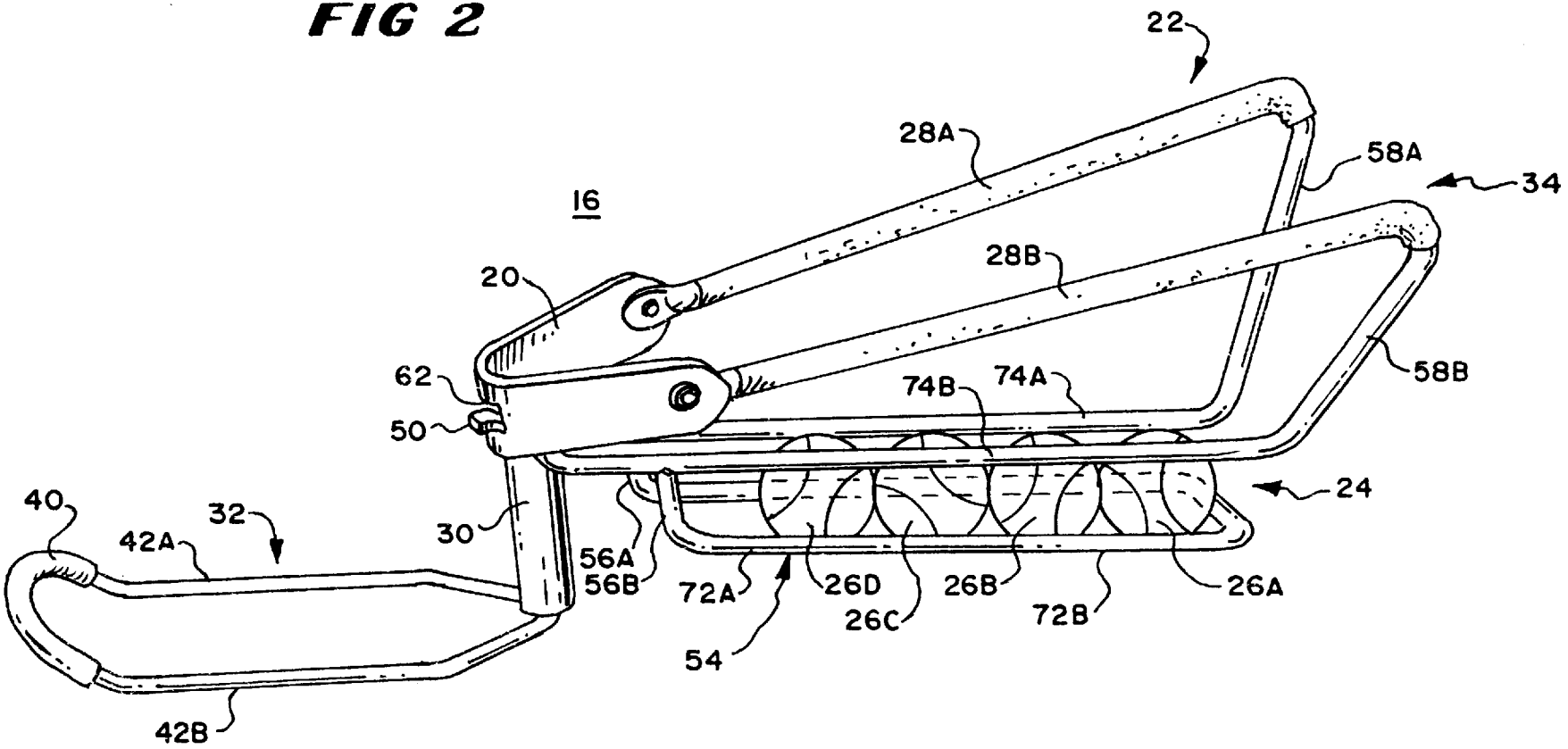
FIG. 2 is a perspective view of a throwing apparatus usable in an embodiment of the invention.

In FIG. 2, there is shown a perspective view of the throwing apparatus 16 having the projectile holder 20, the frame 22, a storage compartment 24 forming a portion of the frame, and thrust bands 28A and 28B. Projectiles may be stored in the storage compartment 24 and thrown by the thrust bands, four such projectiles 26A–26D being shown in FIG. 2.

The frame 22 includes a hand grip 30 and arm rest assembly 32 and a combined thrust-band holder and wing sight 34. The hand grip 30 is a round post comfortably covered with a reasonably firm but soft material and sized to be held in either hand. At one end of the hand grip 30 are mounted the storage compartment 24, thrust bands 28A and 28B and projectile holder 20 extending forwardly from and perpendicular to the hand grip 30 and at the other end of the hand grip 30 is mounted the arm rest assembly 32 extending rearwardly.

The arm rest assembly 32 includes side frame members 42A and 42B and the arm rest 40. The side frame members 42A and 42B extend perpendicular to the vertical hand grip 30 and the arm rest 40 is arcuate and extends upwardly at an angle so that the top of the arc is substantially parallel to the top of the hand grip 30.

In use, the arm of the user is within the arc of the arm rest 40 to steady the throwing apparatus 16 and is above the side members 42A and 42B, which however, are sufficiently spread apart and elongated so that they may pass slightly on either end of the arm without difficulty since the throwing apparatus as a whole is resting on the arcuate arm rest 40. The arm rest 40 is one-quarter inch inner diameter membrane pipe insulation with its two open ends fitting on the end of one-quarter inch diameter 1018 carbon steel cylinders forming the two side members 42A and 42B. The hand grip 30 is black three-quarter inch ID (inner diameter) water hose. Of course any other suitable members may be used and may be of any convenient shape and may be of sufficiently strong material to withstand the forces imparted in throwing a projectile.

In the preferred embodiment, a rest stud for the projectile holder 20 extends from the hand grip 30 on the end opposite to the arm rest assembly 32 in the same direction as the arm rest assembly 32. It is sized to fit through the opening in the projectile holder 20, and as shown in FIG. 2, the hand grip 30 may receive the projectile holder 20 with the projectile-holder rest passing through the hole 62 to hold the projectile holder in a fixed position when it is not in use. The combined storage compartment and pick-up device 24 includes a spring-mounted projectile-holder bottom member 54, a combined thrust band holder and wing sight 34 and two end-connecting members shown in FIG. 2. The end-connecting members are parallel to each other and together they serve the function of holding the spring-mounted projectile-holder bottom 54 in place. The two end-connecting members 56A and 56B connect the spring-mounted projectile-holder bottom 54 to the frame members forming a portion of the combined wing-sight and thrust-band holder to which they are welded.

The top member of the combined storage compartment and pick-up device 24 is the combined thrust-band holder and wing sight 34 to which the end connecting members 56A and 56B are welded. The top and bottom members are spaced sufficiently apart to accommodate the projectiles, which in the embodiment of FIG. 2 are tennis balls having a diameter of approximately three and one-half inches, but the spacing may be variable depending on the projectile. The top and bottom members are one-quarter inch diameter 1018 carbon steel for strength and flexibility and the bottom member is formed integrally with the end connecting members 56A and 56B and extend to their distal end where the two parallel cylinders are connected together to form a loop parallel to the top of the storage compartment 24.

The combined thrust-band holders and wing-sight 34 also includes two parallel extending 1018 carbon steel cylinders 58A and 58B bent upwardly and apart from each other a sufficient distance at their outer ends to permit the tennis balls to pass between them easily and shaped to form a wide wing sight. The wing sight may be used for aiming without the need for the eye to be positioned directly in line with the projectile, thus avoiding a possible danger.

The tops of the members 58A and 58B accommodate expanded portions which may be plastic and are intended to hold the tubular elastomeric thrust bands 28A and 28B in place. In the preferred embodiment, the thrust bands are three-sixteenth inch inner diameter and one-quarter inch outer diameter latex rubber tubing although any other elastomeric member may be used to form elastomeric thrust bands and other types of force impelling members can be used instead of thrust bands.

As can be understood from the above description, the throwing apparatus 16 of this invention has several advantages of its own, which are: (1) it is easy to use; (2) it can provide throwing velocity for a relatively long distance without using any motor force and only using the arms of a human; and (3) it can be used for many purposes such as a throwing device to exercise dogs or any other type of throwing device which may be used in games such as for throwing balls and the like with simple accommodations as to size.

Figure 3:
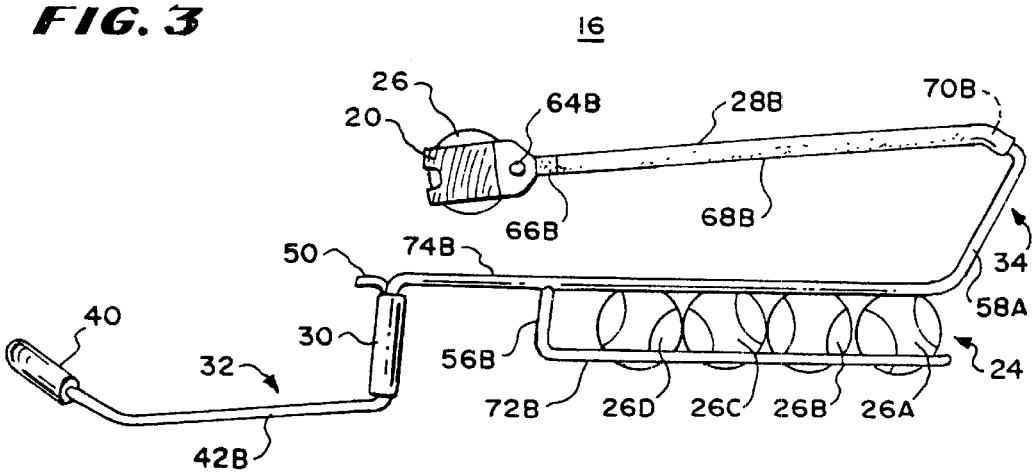
FIG. 3 is an elevational side view of the embodiment of FIG. 2 in one position of its use.
Figure 4:
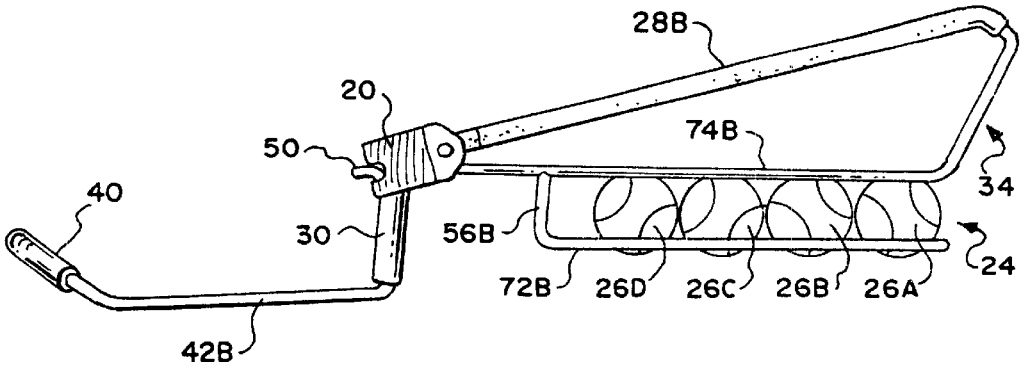
FIG. 4 is a side elevational view of the embodiment of FIG. 2 in another position of its use.

In FIGS. 3 and 4, there is shown a side elevational view of the throwing apparatus 16 in two different positions of use. In FIG. 3, there is shown the throwing apparatus 16 in a position to throw a projectile 26 which is in the projectile holder 20. The thrust bands 28A and 28B (28B only being shown in these FIGS.) are stretched and in position to throw the projectile 26 when released. Four other tennis balls 26A–26D are shown stored in the storage compartment 24 with a bottom member being illustrated as being held by the end connecting member 56B. The projectile holder 20 is shown with the opening 62 being positioned to illustrate how a small object would not be thrown but instead would fall through the opening. As shown in this view, the projectile holder 20 is rectangular and has on each of its ends metal rings crimped in place at 64A and 64B respectively to accommodate the end rings 66A and 66B (66A not being shown) of the elastomeric throwing bands 28A and 28B (28A not being shown). These elastomeric throwing bands 28A and 28B (28A not being shown) include plastic tubing 68A and 68B (only 68B being shown in FIGS. 3 and 4) and fit over an expanded portion shown at 70B of the upwardly extending members 58A and 58B (only 58B being shown in FIGS. 3 and 4). In FIG. 4, there is shown the holder 20 being positioned around the rest stud 50 which passes through the opening sized to permit small undesirable objects to fall through and yet hold the desired projectile within the flexible flat surface.

Figure 5:
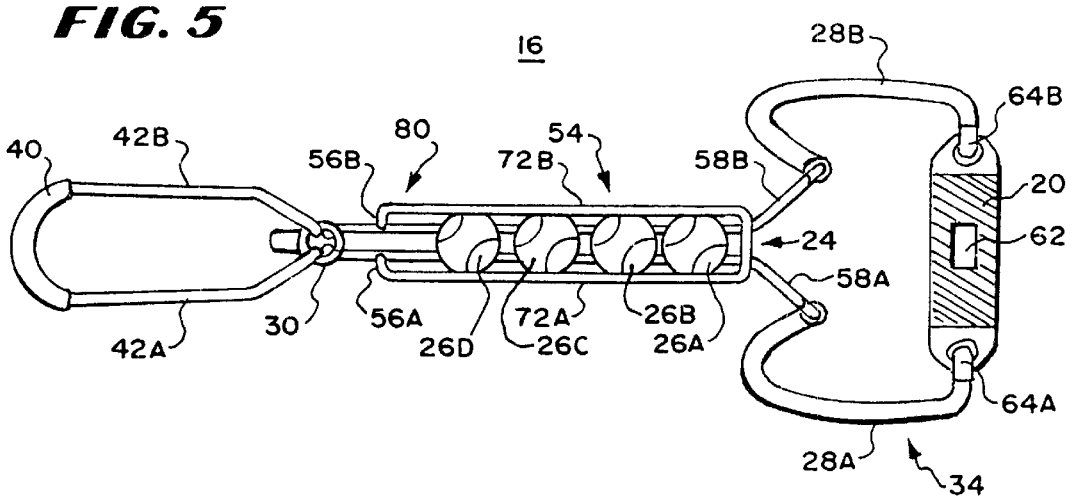
FIG. 5 is a bottom view of the embodiment of FIG. 2.
Figure 6:
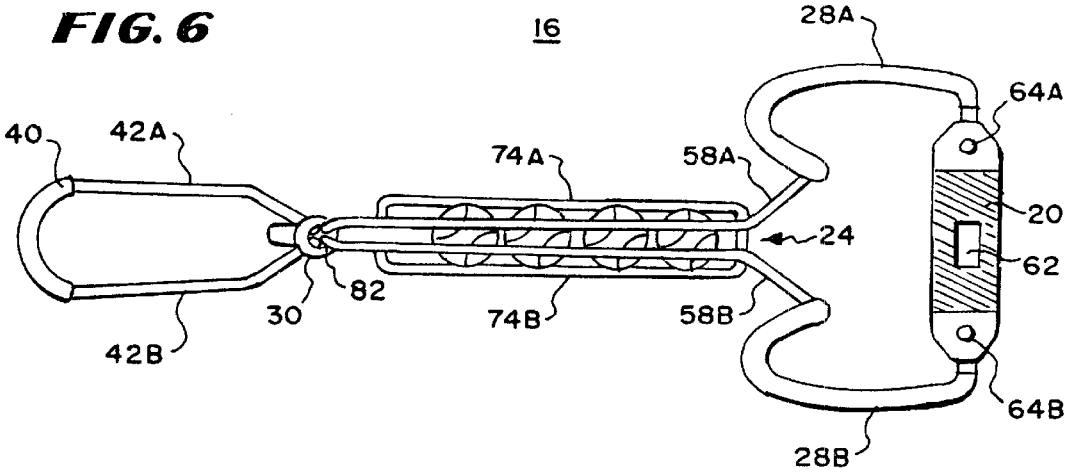
FIG. 6 is a top view of the embodiment of FIG. 2.

In FIGS. 5 and 6, there are shown respectively a bottom and top view of the throwing apparatus 16 particularly illustrating the projectile holder 20, a bottom 54 of the combined storage compartment and pick-up device 24, the hand grip 30, the combined storage compartment and pick-up device 24 and the combined thrust band holders and wing sights 34. As shown best in FIG. 5, which is a bottom view of the throwing apparatus 16, the combined storage compartment and pick-up device 24 has as its bottom member 54 two parallel pipe members 72A and 72B parallel to each other at a distance from each other slightly smaller than the diameter of the tennis balls that are being held so that, at the open end near the bottom, a tennis ball may be forced into them and be held in place.

Because the members 72A and 72B spring outwardly, the open end (shown at the upper end with the reference number 24 in FIGS. 5 and 6) may spring apart slightly between the bottom member 54 and the intermediate frame member holding the guide members which are spread apart to form a wing sight 58A and 58B. These are one-quarter inch diameter 1018 carbon steel in the preferred embodiment although any suitable stiff elongated member could be used as well. These members are held together by their integrally formed upwardly extending end connecting members 56A and 56B which extend upwardly into the intermediate members 74A and 74B where they are bent over and welded together between the parallel pipe members 72A and 72B as best shown at 80.

A projectile holder 20 in the preferred embodiment is 1013 black packing film folded and sewn sown as a rectangular pouch with two one-half inch inner diameter aluminum coated zinc grommets 64A and 64B formed around openings to provide attachment points for the elastomeric bands 28A and 28B respectively. The centrally located hole 62 is circular or square and substantially three-quarters inch in diameter or along its sides and the pouch is substantially 2 inches by 11 inches in the preferred embodiment. However, for tennis balls, the central hole 62 may be of other sizes and shapes such as being less than three inches and greater than one-quarter inch. It should be a central hole within the range of one-eighth of an inch and three inches and said pouch should have as its smallest dimension at least one and three-quarter inches. The largest dimension of said pouch should be greater than the largest dimension of said opening and the smallest dimension of the opening should be less than the largest dimension of the projectile.

The frame assembly consists of three pieces of steel round stock (the 1018 carbon steel cylinders) that are bent together to form the frame work. As mentioned above, they are welded together at 80 to form a spring storage compartment and at another location 82 at the top end of the tubular hand grip 30. The arm rest members 42A and 42B past through the tubing from one end to the other where they are bent in place and welded between the pipe members 74A and 74B to form a firm connection. Thus, the apparatus may be economically built out of inexpensive parts which are easily assembled and require only the two weld points 80 and 82.

From the above detailed description, it can be understood that the method of exercise and the throwing apparatus 16 of the invention have several advantages, such as: (1) the elongated throwing apparatus may be used to pick up balls without touching them with hands and without bending down; (2) balls may be placed in the projectile holder 20 without touching them directly with the hands; (3) the throwing apparatus may be safely aimed to throw a projectile by aiming through the wing type sight; (4) the throwing apparatus may be used with either hand; and (5) the throwing apparatus is simple to make and economical, requiring standard tubing stock and plastic tubing as well as having only two weld points to hold the throwing apparatus 16 together.

Although a specific preferred embodiment of the invention has been described with some particularity, many modifications and variations of the preferred embodiment may be obtained without invention. Therefore, it is to be understood that, within the scope of the appended claims, the invention may be practiced other than as specifically described.

What is claimed is:

1. A method of exercising dogs comprising the steps of:

inserting a projectile into a throwing apparatus;

throwing the projectile for the dog to fetch; and storing projectiles by inserting them into a storage compartment in the throwing apparatus;

the step of storing the projectiles comprises the step of storing balls in a spring-loaded storage compartment; the step of storing the balls in a spring-loaded storage compartment comprising the steps of putting the end of the throwing apparatus on top of a ball and pressing downwardly wherein the ball is forced into the spring-loaded storage compartment, which is exposed to air wherein the stored balls may dry.

2. A method according to claim 1 in which several balls in succession are inserted into the spring-loaded storage compartment.

3. A method of exercising dogs comprising the steps of:

inserting a projectile into a throwing apparatus;

throwing the projectile for the dog to fetch; and storing projectiles by inserting them into a storage compartment in the throwing apparatus;

the step of inserting a projectile comprises the steps of removing a ball from the storage compartment using a ball holding member and throwing the ball utilizing a propulsion force attached to the ball holding member;

the step of throwing the ball comprises the step of pulling the ball holding member back against the force of spring members and releasing it.

4. A throwing apparatus comprising:

a storage compartment which holds projectiles; and a throwing section;

said storage compartment being elongated and spring loaded, wherein the projectiles may be picked up by putting the storage compartment over them and pushing downwardly whereby the projectiles need not be touched by hands in the loading process.

5. A throwing apparatus in accordance with claim 4 in which the throwing section and the storage compartment are mounted in parallel together with a common dividing section wherein there is at least one flexible spring loading section on the storage compartment.

6. A throwing apparatus in accordance with claim 4 in which the storage compartment comprises cylindrical members forming one side of the storage compartment.

7. A throwing apparatus in accordance with claim 4 in which the throwing section includes two elongated cylinders spread apart and an elastomeric member having one end attached to the outer ends of the two cylinders, the other end of the elastomeric member bieng attached to a pouch having a central hole sized so that small objects fall through the hole and large intended objects are held by the pouch.

8. A throwing apparatus according to claim 7 in which the central hole is in the range of one-eighth of an inch and three inches and said pouch has as its smallest dimension at least one and three-quarter inches, a largest dimension of said pouch being greater than the largest dimension of said hole and the smallest dimension of said hole being less than the largest dimension of said projectile.

9. A throwing apparatus in accordance with claim 7 in which the projectiles are intended to have one dimension greater than two inches; said central hole being less than two inches and greater than one and three-quarter inches, whereby small objects will not be held by said pouch but small objects may be held and thrown by said pouch.

10. A throwing apparatus in accordance with claim 7 in which said central hole has a diameter within the range of one-eighth of an inch and two inches and said pouch has its smallest dimension at least one and three-quarter inches; said largest dimension of said pouch being greater than the largest dimension of said opening.

11. A throwing apparatus in accordance with claim 7 in which the central hole is circular and substantially three-quarters inch in diameter and the pouch is substantially 2 inches by 11 inches.

12. A throwing apparatus in accordance with claim 7 in which the central hole is less than three inches and greater than one-quarter inch.

* * * * *